US008858062B2

(12) United States Patent
Guthrie et al.

(10) Patent No.: US 8,858,062 B2
(45) Date of Patent: Oct. 14, 2014

(54) ENCLOSED SLURRY SPREADER ATTACHABLE TO A DISCHARGE CHUTE

(75) Inventors: William Spencer Guthrie, Provo, UT (US); John M. Coyle, Farmington, UT (US); David Odell Anderson, Bluffdale, UT (US); Charles Hope, Provo, UT (US)

(73) Assignee: Brigham Young University, Provo, UT (US)

( * ) Notice: Subject to any disclaimer, the term of this patent is extended or adjusted under 35 U.S.C. 154(b) by 1009 days.

(21) Appl. No.: 12/901,438

(22) Filed: Oct. 8, 2010

(65) Prior Publication Data

US 2011/0132996 A1 Jun. 9, 2011

Related U.S. Application Data

(60) Provisional application No. 61/278,643, filed on Oct. 8, 2009.

(51) Int. Cl.
*B28C 7/16* (2006.01)

(52) U.S. Cl.
USPC ..... 366/68; 239/159; 193/10

(58) Field of Classification Search
USPC ..... 366/53–59, 44, 68, 187; 239/159; 193/4–6, 10
See application file for complete search history.

(56) References Cited

U.S. PATENT DOCUMENTS

| | | | | | |
|---|---|---|---|---|---|
| 1,040,392 | A * | 10/1912 | Ogle et al. | ..... | 193/2 R |
| 1,364,581 | A * | 1/1921 | Ramsey | ..... | 193/6 |
| 2,011,894 | A | 5/1935 | Etnyre | | |
| 2,764,450 | A * | 9/1956 | Rosener | ..... | 298/7 |
| 3,746,140 | A * | 7/1973 | Schiffelbein | ..... | 193/5 |
| 4,007,821 | A * | 2/1977 | Schiffelbein | ..... | 193/4 |
| 4,082,227 | A | 4/1978 | McGrane | | |
| 4,684,062 | A | 8/1987 | Bagwell | | |
| 4,688,667 | A * | 8/1987 | Peterson | ..... | 193/10 |
| 4,828,429 | A | 5/1989 | Kirchner | | |
| 5,064,292 | A | 11/1991 | Sutton | | |
| 5,407,299 | A | 4/1995 | Sutton | | |
| 5,531,518 | A * | 7/1996 | Alves | ..... | 366/68 |
| 6,106,141 | A * | 8/2000 | Bruun | ..... | 366/68 |
| 6,782,925 | B2 * | 8/2004 | Raposo et al. | ..... | 141/5 |
| 6,866,047 | B1 | 3/2005 | Marvin | | |
| 7,178,657 | B1 * | 2/2007 | Hafen et al. | ..... | 193/4 |
| 7,506,672 | B2 * | 3/2009 | Manno | ..... | 141/86 |
| 8,336,585 | B2 * | 12/2012 | Royce | ..... | 141/332 |
| 8,522,948 | B1 * | 9/2013 | Galvin, IV | ..... | 193/10 |
| 2006/0239112 | A1 | 10/2006 | Graeber | | |
| 2008/0175092 | A1 * | 7/2008 | Manno | ..... | 366/68 |
| 2009/0229706 | A1 * | 9/2009 | Royce | ..... | 141/331 |
| 2009/0229707 | A1 * | 9/2009 | Royce | ..... | 141/332 |
| 2011/0132996 | A1 * | 6/2011 | Guthrie et al. | ..... | 239/159 |

* cited by examiner

*Primary Examiner* — Charles Cooley

(57) ABSTRACT

An apparatus for distributing a slurry can include a trough configured to be removably attached to a discharge chute of a ready-mix truck and receive a slurry discharged therefrom where the trough has a front including a flange configured to extend under the discharge chute. The apparatus can include an enclosed basin connected to a lower end of the trough proximate to a midpoint of the enclosed basin and an aperture defined within the enclosed basin and configured to enable the slurry to flow from the trough into the enclosed basin. The enclosed basin can include at least one covered access port where the at least one covered access port is configured to be opened and configured to be closed. The apparatus can include a plurality of drainage nozzles disposed along a bottom of the enclosed basin and configured to distribute the slurry to a plurality of locations.

11 Claims, 2 Drawing Sheets

ENCLOSED SLURRY SPREADER ATTACHABLE TO A DISCHARGE CHUTE

CROSS-REFERENCE TO RELATED APPLICATIONS

This U.S. Patent Application claims the benefit of U.S. Provisional Application 61/278,643 filed Oct. 8, 2009, titled "Slurry Spreader," which is incorporated herein by reference in its entirety.

BACKGROUND OF THE INVENTION

Slurries are used in pavement construction and may comprise mixtures of portland cement, fly ash, lime, proprietary products, and/or other mineral or chemical admixtures, also called stabilizers, with water or another diluent. In the full-depth reclamation process, a method for rehabilitating pavements, road beds are typically prepared by pulverization, grading, and compacting before being topped with a wearing course such as concrete or asphalt. When full-depth reclamation in conjunction with stabilization is specified for a given project, the dry stabilizer, in powder form, is applied to the road base and/or sub-base layer(s) prior to the placement of a pavement wearing course. The powder is then mixed into the road base; the base is then compacted, graded, and shaped again as desired.

While this method of road bed treatment with a stabilizer, if properly applied, typically results in a suitable base for roads, the step involving the distribution of the dry powder almost inevitably generates fugitive dust. In addition to being harmful to humans and to the environment, the dust creates a cleanup problem, since some of the dust eventually settles and deposits itself on surrounding surfaces. For these reasons, the benefits of many forms of road bed stabilization are limited to open, rural areas. Although application in urban areas would be very desirable, the dust problems preclude the use of this technique. Because the clouds of fugitive dust are both inconvenient and harmful, it is advantageous to apply a slurry, instead of a powder, to a prepared road bed. Use of a slurry eliminates the clouds of dust and their associated problems. However, slurries are often imperfectly mixed and may contain debris from neglecting to properly clean the mixing chamber or exposure to the environment.

Due to the foregoing and other issues a need exists for an improved slurry spreader.

SUMMARY OF THE INVENTION

An apparatus for distributing a slurry may include a trough configured to be removably attached to a discharge chute of a cement truck and receive a slurry discharged therefrom. The upper end of the trough may include a flange configured to extend under the discharge chute and prevent spillage therefrom. A enclosed basin may be connected to a lower end of the trough proximate to a midpoint of the enclosed basin such that the enclosed basin is substantially perpendicular to the trough.

An aperture formed into the enclosed basin may enable the slurry to flow from the trough into the enclosed basin. The enclosed basin may also include at least one covered access port disposed at an end or top thereof that can be opened to provide access to the interior of the enclosed basin and closed to prevent contamination of the slurry.

A plurality of adjustable drainage nozzles may be disposed along the bottom of the enclosed basin that concurrently distribute the slurry to a plurality of locations and thereby facilitate efficient coverage of a roadbed with the slurry.

In certain embodiments, the enclosed basin is cylindrical and the trough is a half-pipe and/or a radius of the trough is substantially equal to a radius of the enclosed basin. The slurry spreader may include a screen attachment that covers the aperture and filters the slurry.

With respect to the foregoing description, it is to be understood that the optimal dimensional relationships for the parts of the slurry spreader, to include variations in size, materials, shape, form, function and manner of operation, assembly, and use are deemed readily apparent to one skilled in the art. All equivalent relationships to those illustrated in the drawings and described in the specification are intended to be encompassed by the present design. Therefore, the foregoing is intended to be considered as merely illustrative of the principles of the slurry spreader. Furthermore, since numerous modifications and alterations will readily occur to those skilled in the art, it is not intended to limit the design to the exact construction and operation shown and described; accordingly, all suitable modifications and equivalents that may be resorted to should be considered to fall within the scope of the invention.

BRIEF DESCRIPTION OF THE DRAWINGS

In order to describe the manner in which the above-recited and other advantages and features can be obtained, a more particular description of the subject matter briefly described above will be rendered by reference to a specific embodiment which is illustrated in the appended drawings. Understanding that these drawings depict only a typical embodiment and are not therefore to be considered to be limiting in scope, the embodiment will be described and explained with additional specificity and detail through the use of the accompanying drawings in which.

DETAILED DESCRIPTION

Figure 1:
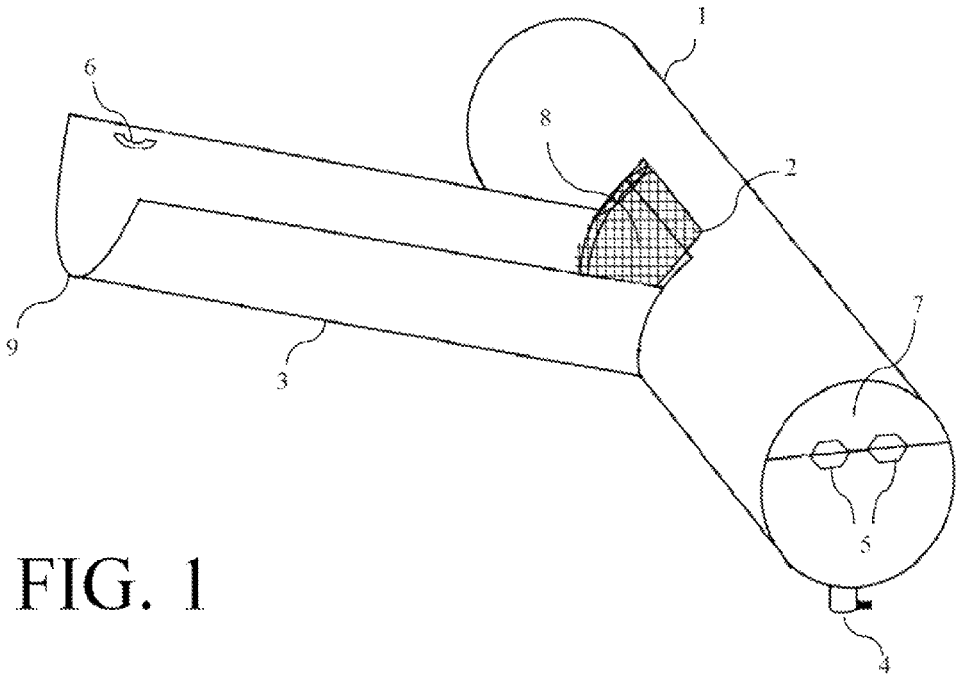
FIG. 1 is a perspective view drawing illustrating one embodiment of a slurry spreader.
Figure 2:
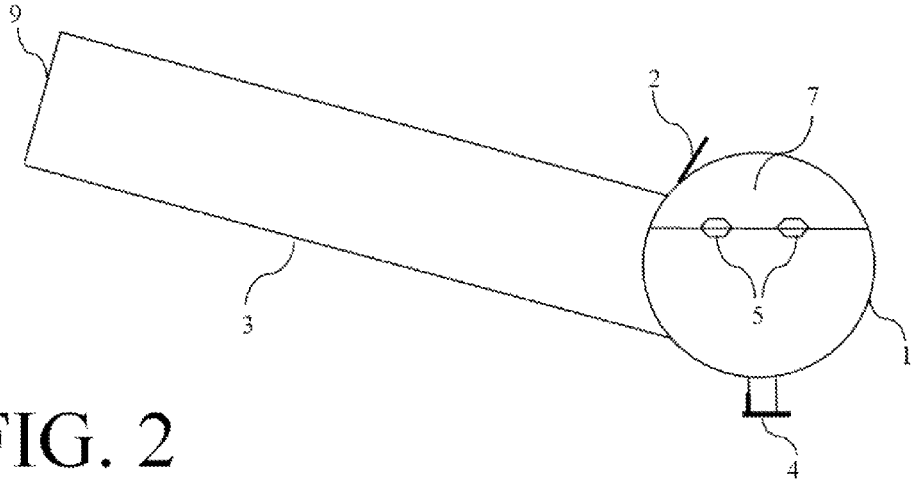
FIG. 2 is a side view drawing illustrating one embodiment of the slurry spreader, as seen from the side of a basin with an attached covered access port.
Figure 3:
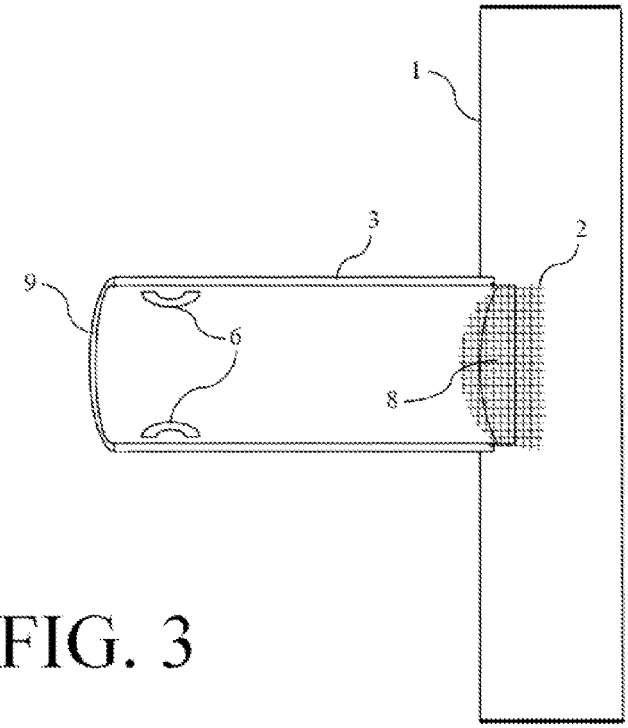
FIG. 3 is a top view drawing illustrating one embodiment of the slurry spreader.
Figure 4:
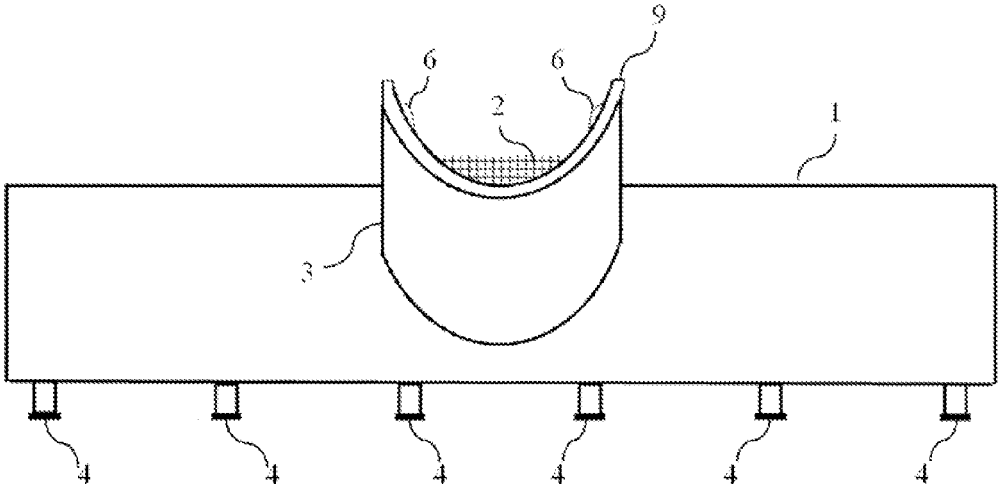
FIG. 4 is a rear view drawing illustrating one embodiment of the slurry spreader when the device is mounted in position for use.

FIG. 1 illustrates a perspective view of one embodiment of a slurry spreader. FIGS. 2, 3, and 4 illustrate the slurry spreader from the side, top, and rear (the side proximal to the discharge chute when the slurry spreader is mounted), respectively.

As depicted in FIGS. 1-4, a half-pipe trough 3 may be perpendicularly attached to an enclosed basin 1 that may be isolate the slurry from the environment while the slurry spreader is in use. A screen 2 may be removably attached at the junction of the trough 3 and the basin 1 and filter a slurry that passes down the trough 3, through the opening 8, and into the basin 1. Filtering the slurry may ensure that the slurry is reasonably homogeneous previous to distribution of the slurry to the road bed. The use of the screen 2 instead of a motorized mixer or pump may eliminate the need for moving parts or wiring from the spreader to the truck.

Attachment devices 6 may be attached to the trough 3 in order to secure the trough to the discharge chute of a ready-mix truck while the slurry spreader is in use. Adjustable nozzles 4 may be mounted lengthwise across the bottom of the basin 1 and used to discharge the slurry to the road or other desired surface. Hinges 5 may attach to a cover for one or more covered access port(s) 7 on the side or top of the basin 1 to enable access to the slurry and clean the slurry spreader after use.

The slurry spreader described herein attaches to the discharge chutes that are standard on ready-mix trucks. When attached to such a discharge chute, the slurry spreader directs the flow of slurry from the truck into the slurry spreader's closed-top basin. A screen situated at the entry point of the basin prevents debris lumps and irregular nodules in the cement mixture from entering the basin. The slurry is then discharged onto the road or other desired surface through a plurality of adjustable drainage nozzles situated at the bottom of the basin.

Referring again to the Figures, an apparatus for distributing a slurry may include a trough 3 configured to be removably attached to a discharge chute of a cement truck and receive a slurry discharged therefrom. The upper end of the trough may include a flange 9 configured to extend under the discharge chute and prevent spillage therefrom. A enclosed basin 1 may be connected to a lower end of the trough proximate to a midpoint of the enclosed basin such that the enclosed basin 1 is substantially perpendicular to the trough 3.

An aperture 8 formed into the enclosed basin 3 may enable the slurry to flow from the trough into the enclosed basin. The enclosed basin 3 may also include at least one covered access port disposed at an end or the top thereof that can be opened to provide access to the interior of the enclosed basin and closed to prevent contamination of the slurry.

A plurality of adjustable drainage nozzles 4 may be disposed along the bottom of the enclosed basin that concurrently distribute the slurry to a plurality of locations and thereby facilitate efficient covered access portage of a roadbed with the slurry.

In certain embodiments, the trough 3 is a half-pipe and/or a radius of the trough is substantially equal to a radius of the enclosed basin. The slurry spreader may include a screen attachment 2 that covered access ports the aperture and filters the slurry.

In various embodiments and configurations, the depicted slurry spreader may provide certain advantages and benefits. For example, the spreader may be attached to a discharge chute of a ready-mix truck and facilitate distributing the slurry to a selected location by positioning the discharge chute. Furthermore, the slurry spreader's basin may be closed to prevent contamination and opened to facilitate cleaning.

In certain embodiments, the relatively small size of the spreader enables as few as one or two people to attach the spreader to, or remove it from, the chute of a ready-mix truck in a matter of seconds. Other slurry distributors generally cannot be engaged and disengaged so quickly by so few people.

The purpose of the foregoing description is to enable the U.S. Patent and Trademark Office and the general public—especially scientists, engineers, and practitioners in the art who are not familiar with patent terminology—to quickly determine from a cursory inspection the nature and essence of the technical disclosure of the application. The description and the abstract are not intended to define the slurry spreader as specified by the claims, nor are they intended to limit the scope of the claims.

What is claimed is:

1. An apparatus for distributing a slurry, the apparatus comprising:

a trough configured to be removably attached to a discharge chute of a ready-mix truck and receive a slurry discharged therefrom, a front of the trough comprising a flange configured to extend under the discharge chute and prevent spillage therefrom;

an enclosed basin connected to a lower end of the trough proximate to a midpoint of the enclosed basin such that the enclosed basin is substantially perpendicular to the trough;

an aperture formed into the enclosed basin and configured to enable the slurry to flow from the trough into the enclosed basin, the enclosed basin including at least one covered access port, the at least one covered access port configured to be opened to provide access to an interior of the enclosed basin and to be closed to prevent contamination of the slurry; and a plurality of drainage nozzles disposed along a bottom of the enclosed basin and configured to concurrently distribute the slurry to a plurality of locations.

2. The apparatus of claim 1, wherein the trough is a half-pipe.

3. The apparatus of claim 1, wherein the enclosed basin is cylindrical.

4. The apparatus of claim 3, wherein a radius of the trough is substantially equal to a radius of the enclosed basin.

5. The apparatus of claim 1, further comprising a screen attachment configured to cover the aperture and filter the slurry.

6. An apparatus, comprising:

a trough configured to be removably attached to a discharge chute of a ready-mix truck and receive a slurry discharged therefrom, the trough having a front including a flange configured to extend under the discharge chute;

an enclosed basin connected to a lower end of the trough proximate to a midpoint of the enclosed basin;

an aperture defined within the enclosed basin and configured to enable the slurry to flow from the trough into the enclosed basin, the enclosed basin including at least one covered access port, the at least one covered access port configured to be opened and configured to be closed; and a plurality of drainage nozzles disposed along a bottom of the enclosed basin and configured to distribute the slurry to a plurality of locations.

7. The apparatus of claim 6, wherein the trough has a half-pipe shape.

8. The apparatus of claim 6, wherein the enclosed basin has a cylindrical shape.

9. The apparatus of claim 6, wherein the trough has a radius substantially equal to a radius of the enclosed basin.

10. The apparatus of claim 6, further comprising:

a screen attachment configured to cover the aperture and filter the slurry.

11. The apparatus of claim 6, wherein the enclosed basin is substantially perpendicular to the trough.

* * * * *